US010660810B1

(12) United States Patent
Zwettler

(10) Patent No.: US 10,660,810 B1
(45) Date of Patent: May 26, 2020

(54) SUPPORT APPARATUS AND METHOD WITH SHEAR RELIEF

(71) Applicant: Chris James Zwettler, Stillwater, MN (US)

(72) Inventor: Chris James Zwettler, Stillwater, MN (US)

(73) Assignee: THINAIR SURFACES LLC, Stillwater, MN (US)

( * ) Notice: Subject to any disclaimer, the term of this patent is extended or adjusted under 35 U.S.C. 154(b) by 662 days.

(21) Appl. No.: 15/157,119

(22) Filed: May 17, 2016

Related U.S. Application Data

(60) Provisional application No. 62/162,767, filed on May 17, 2015.

(51) Int. Cl.
*A61G 7/057* (2006.01)

(52) U.S. Cl.
CPC ..... *A61G 7/05776* (2013.01); *A61G 2203/34* (2013.01); *A61G 2203/74* (2013.01)

(58) Field of Classification Search
CPC ..... A61G 7/05769; A61G 7/05776; A47C 27/08; A47C 27/081; A47C 27/082; A47C 27/083; A47C 27/10
See application file for complete search history.

(56) References Cited

U.S. PATENT DOCUMENTS 2,998,817 A * 9/1961 Armstrong ..... A61F 7/10 165/46
3,317,934 A * 5/1967 Hinrichs ..... A61G 7/05776 5/422
3,674,019 A * 7/1972 Grant ..... A61G 7/05776 601/148
4,651,369 A * 3/1987 Guldager ..... A47C 27/081 137/869
4,914,771 A * 4/1990 Afeyan ..... A61G 7/05769 5/713
5,010,608 A 4/1991 Barnett et al.
5,539,942 A * 7/1996 Melou ..... A61G 7/05776 5/655.3
5,611,096 A 3/1997 Bartlett et al.
5,657,499 A * 8/1997 Vaughn ..... A61G 7/057 5/654
5,920,934 A 6/1999 Hannagan et al.
5,963,997 A * 10/1999 Hagopian ..... A61G 7/05776 5/654
5,991,949 A * 11/1999 Miller, Sr. ..... A61G 7/05769 5/710
6,571,825 B2 6/2003 Stacy
6,698,046 B1 3/2004 Wu
6,832,629 B2 12/2004 Wu
6,928,681 B1 8/2005 Stacy
7,036,171 B2 5/2006 Wu
(Continued)

FOREIGN PATENT DOCUMENTS

EP 2050425 A1 4/2009

*Primary Examiner* — Nicholas F Polito
(74) *Attorney, Agent, or Firm* — Crawford Maunu PLLC

(57) ABSTRACT

Various aspects of the present disclosure are directed to an apparatus and/or method involving respective sets of interleaved elongated pressure cells, which operate to inflate and deflate independently of one another. The pressure cells further provide shear relief by deflecting along a direction of movement along a width of/perpendicular to a length of the elongated pressure cells.

21 Claims, 6 Drawing Sheets

(56) References Cited

U.S. PATENT DOCUMENTS

| | | | | |
|---|---|---|---|---|
| 7,225,488 | B2 | 6/2007 | Wu | |
| 7,414,536 | B2 | 8/2008 | Call et al. | |
| 7,681,269 | B2 * | 3/2010 | Biggie | A61G 7/001 5/709 |
| 8,051,516 | B2 | 11/2011 | Carlson et al. | |
| 8,104,126 | B2 | 1/2012 | Caminade et al. | |
| 8,196,239 | B2 | 6/2012 | Carlson et al. | |
| 9,216,122 | B2 | 12/2015 | Dzioba et al. | |
| 2002/0133882 | A1 * | 9/2002 | Chapman | A61G 7/05776 5/713 |
| 2004/0098807 | A1 * | 5/2004 | Ham | A47C 27/081 5/655.3 |
| 2004/0128772 | A1 * | 7/2004 | Branson | A61G 7/05776 5/713 |
| 2014/0210250 | A1 * | 7/2014 | DiFelice | B60N 2/525 297/452.48 |

* cited by examiner

SUPPORT APPARATUS AND METHOD WITH SHEAR RELIEF

OVERVIEW

Aspects of various embodiments are directed to apparatuses and methods for providing support, with shear relief.

Pressurized support structures are useful for a variety of purposes. Such structures may be used to support the weight of a person. However, for certain applications involving relatively long periods of immobility or low mobility, such pressure applied can pose challenges. For instance, patients lying on a hospital bed may develop ulcers. Further, pressurized support structures can cause discomfort, relative to movement and otherwise.

These and other matters have presented challenges to the manufacture and implementation of such devices, for a variety of applications.

SUMMARY

Various example embodiments are directed to some or all components of an apparatus and its implementation, involving the application of pressure for treatment, therapy and/or support. Such aspects may address one or more issues such as those addressed above and/or others which may become apparent. Various embodiments thus address challenges to the treatment of patients under conditions in which the patients are immobile or move very little for a period of time.

In accordance with various embodiments, an apparatus includes first and second sets of elongated pressure cells in which cells in the first set are interleaved with cells in the second set. Each set of elongated pressure cells is operable to inflate and deflate independently of the other set. The elongated pressure cells have a length and width and provide shear relief by deflecting in a direction that is perpendicular to the length of the elongated pressure cells.

Another embodiment is directed to a method as follows. A membrane is formed with recesses for first and second set of elongated pressure cells, with alternating ones of the elongated pressure cells being interleaved. A first pressure inlet channel is coupled to the first set of elongated pressure cells, and a second pressure inlet channel is coupled to the second set of elongated pressure cells. The elongated pressure are cells sealed by coupling the membrane to an underlying sheet, therein configuring each set of the elongated pressure cells to: inflate and deflate independently of the other of the first and second sets, and while inflated, provide shear relief by deflecting in a direction that is perpendicular to the length of the elongated pressure cells.

The above discussion/summary is not intended to describe each embodiment or every implementation of the present disclosure. The figures and detailed description that follow also exemplify various embodiments.

BRIEF DESCRIPTION OF FIGURES

Various example embodiments may be more completely understood in consideration of the following detailed description in connection with the accompanying drawings, in which.

Figure 1:
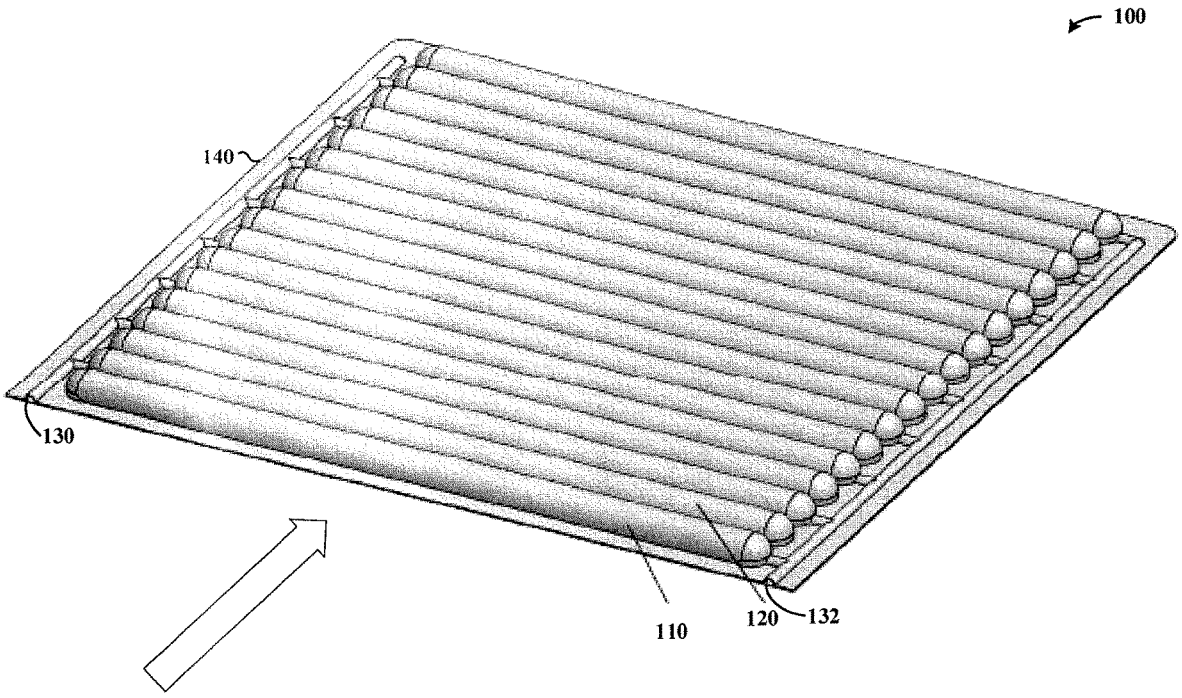
FIG. 1 shows an isometric view of an apparatus in accordance with the present disclosure.

While various embodiments discussed herein are amenable to modifications and alternative forms, aspects thereof have been shown by way of example in the drawings and will be described in detail. It should be understood, however, that the intention is not to limit the disclosure to the particular embodiments described. On the contrary, the intention is to cover all modifications, equivalents, and alternatives falling within the scope of the disclosure including aspects defined in the claims. In addition, the term "example" as used throughout this application is only by way of illustration, and not limitation.

DETAILED DESCRIPTION

Aspects of the present disclosure are believed to be applicable to a variety of different types of apparatuses, systems and methods involving the application of pressure with relief in a shear direction. Various embodiments are amenable to implementation for the support of the human body, such as between a support (e.g., part of a bed or chair/seat) and a person's skin or clothing. Certain embodiments are directed to ulcer prevention in a medical setting, as may be applicable to a gurney or bed, such as in a surgical setting. Other embodiments are directed to application with instances where a patient or individual is immobile for long periods of time, such as those in which the patient or individual is at risk of developing decubitus ulcers or otherwise subjected to discomfort. These and other embodiments may be implemented with a pressurized support structure that operates by applying support that alternates between different components within the structure, such as by inflating and deflating adjacent pressure cells. The pressurized support structure also provides for movement/flexibility along one or more shear directions.

In various embodiments, movement/flexibility in a shear direction is provided to allow movement of an individual along a shear direction while mitigating discomfort that may otherwise arise from surfaces that are not flexible in such a shear direction. In connection with such embodiments, it has been discovered that relative of adjacent elongated pressure cells having a length that is perpendicular to a direction of patient movement and a width that is relatively shorter than the length facilitates movement of the pressure cells along a shear direction. This movement can provide relief of shear pressure that may otherwise exist in support structures, such as by providing long cells (e.g., having a cell length that is ten or more times cell width) normal to expected movement of a body lying on the cells. Such elongated pressure cells can "roll" relative to the length dimension of the patient, which can mitigate shearing effects upon a patient's skin, which can mitigate contact pressure for reducing/minimizing stresses that cause decubitus ulcers.

It has further been discovered that such an anti-shear effect can be achieved while preventing "bottoming out" of a patent lying on the cells with some of the cells being deflated, by placing the elongated cells in relative proximity. Such support can be provided for a target weight (e.g., for a weight range of a human body lying on the cells), such that a sufficient number of elongated cells in sufficient proximity are in an inflated (and supporting) state, where the terms "sufficient" are such that the target weight is supported and being insufficient in this regard would allow bottoming out. In Further, by providing multiple small cells that interact with bony prominences of patients, movement is facilitated along with inflation/deflation of individual cells while preventing such prominences from bottoming out (e.g., through the cells to an underlying structure).

Controlling the inflation and deflation of respective pressure cells can be tailored to particular applications. For example, a first set of pressure cells that are deflated may be cycled to inflate while a second set of interleaved pressure cells remain inflated until the first set of pressure cells are partially or fully inflated, after which the second set of interleaved pressure cells are deflated. In some embodiments, a high level of support is provided during an initial period, such as when a patient is lifted onto a bed or climbs onto the bed, by inflating most or all pressure cells. After the patient has settled onto the bed and is in a relaxed position, fluid in respective sets of the cells is alternatingly with evacuated and filled to create alternating pressure support as noted herein.

In accordance with various embodiments, an apparatus includes first and second sets of elongated pressure cells in which cells in the first set are interleaved with cells in the second set. Each set of elongated pressure cells is operable to inflate and deflate independently of the other set. The elongated pressure cells have a length and width and provide shear relief by deflecting in a direction that is perpendicular to the length of the elongated pressure cells. This approach can be used to prevent flattening of the pressure cells onto the underlying surface under a patient's weight and/or prevent a portion of the patient's body from exerting direct pressure (e.g., via a collapsed pressure cell) onto an underlying surface via an empty/evacuated pressure cell.

In this context, an elongated pressure cell is a pressure cell having a length greater than its width, such that it is operable to provide shear relief in a direction along the width. This may, for example, involve a pressure cell having a length that is five, ten or more times its width. These aspects may further involve an undercut region that facilitates roll as characterized herein.

In various embodiments, each elongated pressure cell includes respective undercut regions extending along a length of the elongated pressure cell at intersections between the pressure cell and an underlying surface. For instance, where formed as part of an upper sheet that is laminated onto another sheet, the undercut may be provided at the intersection between a flat portion of that sheet and a protrusion that forms the pressure cell. The width of the elongated pressure cell at the intersection is less than a width of a cross-section of the pressure cell that is elevated above the intersection (e.g., with the pressure cell inflated), which can provide movement of the cell in response to shear pressure/movement of a patient or object in contact with an upper portion of the pressure cells. The width of such an elevated cross-section can be set sufficiently larger than the width of the elongated pressure cell at the intersection to facilitate the deflection of an upper portion of the elongated pressure cell in a direction along the width thereof, thereby providing the shear relief. In this context, a sufficiently larger width is one that permits a desired amount of deflection along the direction of the width. In some instances, the width/undercut can be set to provide movement of about 10 mm of an upper surface of the cells while imparting little or no shear force onto an object resting on the upper surface. This deflection may be exhibited, for example, when the elongated pressure cells are inflated and in contact with a patient supported thereby.

Various embodiments also include fluid delivery componentry that selectively inflates and deflates the first and second sets of elongated pressure cells. This componentry may include valving and a pump that operates to effect the inflation and deflation of the elongated pressure cells independently from one another for respective periods of time. The valving and pump may thus be implemented to inflate the first set of elongated pressure cells during a first period of time while the second set of elongated pressure cells is deflated or in a partially inflated state, and similarly inflate the second set of elongated pressure cells during a second period of time while the first set of elongated pressure cells is deflated. Evacuation and filling of the pressure cells may be carried out using fluid that is cycled between the two sets of pressure cells and/or shared in a common reservoir. For instance, a reversible pump may be used with the sets of elongated pressure cells to evacuate fluid from one of the sets of elongated pressure cells and to utilize the evacuated fluid to inflate the other one of the sets of elongated pressure cells.

Other embodiments include third and fourth sets of elongated pressure cells, with each elongated pressure cell in the third set being interleaved with elongated pressure cells of the fourth set. The elongated pressure cells in the third and fourth sets may extend in a direction that is different than the direction of the length of the elongated pressure cells in the first and second sets of elongated pressure cells.

Another embodiment is directed to a method as follows. A membrane is formed with recesses for first and second set of elongated pressure cells, with alternating ones of the elongated pressure cells being interleaved. A first pressure inlet channel is coupled to the first set of elongated pressure cells, and a second pressure inlet channel is coupled to the second set of elongated pressure cells. The elongated pressure are cells sealed (e.g., laminated) by coupling the membrane to an underlying sheet, therein configuring each set of the elongated pressure cells to: inflate and deflate independently of the other of the first and second sets, and while inflated, provide shear relief by deflecting in a direction that is perpendicular to the length of the elongated pressure cells. The size of the recesses can be set such that, when coupled to the underlying sheet, sufficient support is provided for a patient having a target weight and to prevent flattening of the pressure cells onto an underlying surface while supporting the patient.

In some implementations, each elongated pressure cell is formed with respective undercut regions extending along a length of the pressure cell at intersections between the pressure cell and an underlying surface. The width of the elongated pressure cell at the intersection is set to be less than a width of a cross-section of the elongated pressure cell that is elevated above the intersection. The elevated cross-section may, for example, have a width that is sufficiently larger than the width of the elongated pressure cell at the intersection to facilitate deflection of an upper portion of the elongated pressure cell in a direction along the width thereof (and thereby providing the shear relief).

Turning now to the Figures, FIG. 1 shows an isometric view of an apparatus 100 in accordance with the present disclosure. The apparatus 100 includes a plurality of adjacent pressure cells, including cells 110 and 120 labeled by way of example. Fluid inlet channels 130 and 132 are respectively coupled to alternating ones of the pressure cells, and operable for inflation and deflation thereof. In some instances, a fluid such as air is filled in pressure cell 120 and every other alternating cell therefrom via fluid inlet channel 130, while pressure cell 110 and every other alternating cell therefrom are partially or fully deflated. Such a fluid can then be evacuated from the filled pressure cells (including pressure cell 120), with fluid (the same or other fluid) being filled to inflate pressure cell 110 and those alternating therefrom. The inflation/deflation may be implemented such that support is provided at all times by one or both of the sets of alternating pressure cells.

In various embodiments, the alternating pressure cells are configured and arranged to deflect under shear stress in a direction as indicated by the arrow in FIG. 1. For instance, where pressure cell 110 and those alternating therefrom (and coupled to fluid inlet channel 132) are inflated, those inflated pressure cells provide some roll, or movement, in the direction of the arrow so as to mitigate the development of shear stress. Such an approach can achieve benefits, including those as noted above.

A variety sizes and arrangements of pressure cells are implemented to address certain shear-stress applications. For instance, while FIG. 1 shows a rectangular sheet, sheets of various shapes and sizes are used to suit particular applications. In addition, where shear stresses are anticipated as occurring in different directions at different points of contact (e.g., along a patient's body), the arrangement of elongated pressure cells can be tailored to suit mitigation of such stress.

The construction of the apparatus 100 may also be tailored to suit particular embodiments, such as to incorporate available materials or manufacturing approaches. In some embodiments, the apparatus 100 is a two-part laminate structure with a relatively flat lower layer to which an upper layer is adhered (e.g., along edges of the apparatus at 140). The upper layer has recesses that form the pressure cells and fluid inlet channels as shown.

Figure 2:
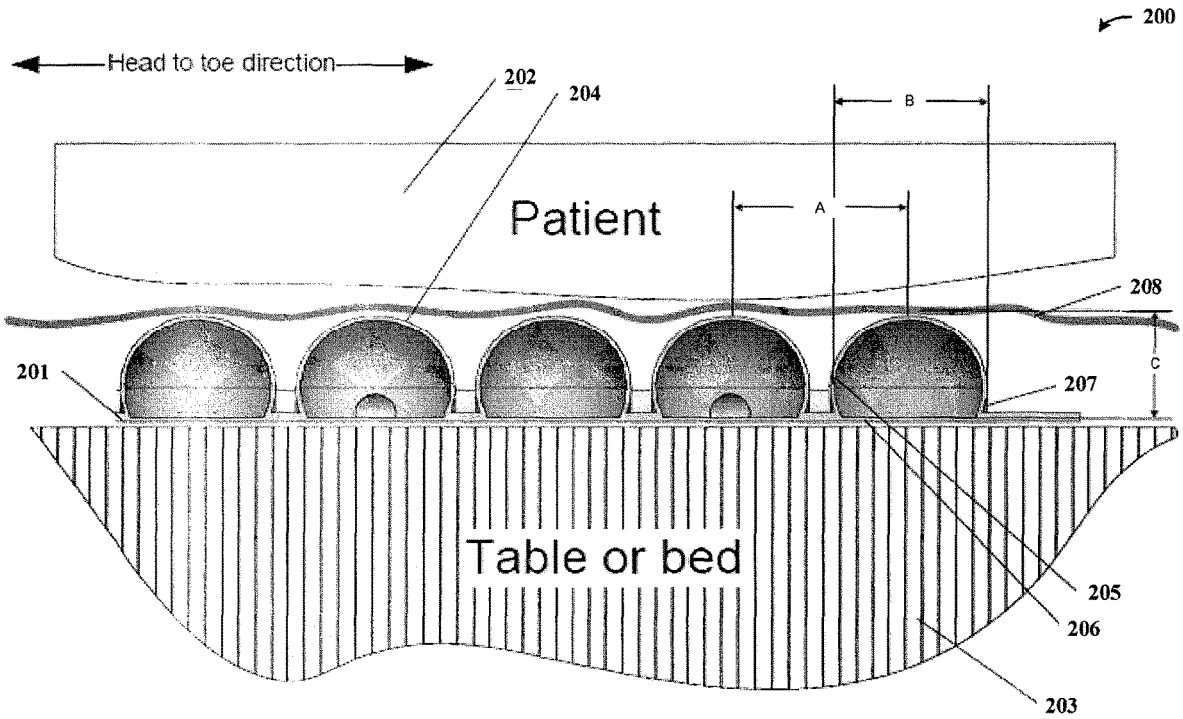
FIG. 2 shows a section view of an apparatus, in accordance with the present disclosure.

FIG. 2 shows a section view of an apparatus 200, in accordance with the present disclosure. The apparatus 200 includes a support pad 201 operable to support a patient (202), and is shown by way of example positioned between the patient and support 203 (e.g., a table or bed) that the patient is resting on. The support pad 201 includes of long, thin, parallel, tubular cells 4 with length dimension aligned in a transverse direction to the height (head to toe) dimension of the patient. Five pressure cells are shown by way of example, including pressure cell 204, with alternating ones of the pressure cells being coupled to a common pressure inlet for alternate inflation/deflation. This alternate inflation/deflation can be carried out to relieve local contact pressure against the patient.

Each pressure cell is connected to an underlying surface at undercut regions 207, with a cross-section at the underlying surface being less than that at an elevated portion of the pressure cell (e.g., cross-section "B"). This undercut facilitates movement of an upper surface of each cell along with movement of the patient along the indicated head-to-toe direction, which runs in a direction along the width of each cell. This movement or "roll" effect helps to mitigate or prevent shear tension on the patient 202 as the patient moves relative to the table or bed (and the upper surface of the pressure cells moves with the patient with low/minimal stress). It has been discovered that this approach, together with other aspects noted herein relating to the alternation of pressure application (e.g., and related capillary blood flow enhancement) can address issues as noted herein, such as those relating to ulcers or other conditions that may develop with patients. The undercut can thus serve to relieve shear stress as the bony prominence moves in a direction tangential to the support 203, such as when a patient is positioned or repositioned, or when the support is moved (e.g., as with an adjustable bed).

In various embodiments, the size, height and spacing of the cells are set with inflation pressure therein such that a bony prominence of a patient having a target weight will not "bottom out" against the support 203, in the location of one of the deflated cells or otherwise. Accordingly, these parameters can be set relative to one another and an expected weight to be supported, relative to comfort. Further, different regions of the support pad 201 may be implemented with differently-sized pressure cells, based on expected load. For instance, a load supporting a patient's torso may be higher than a load supporting a patient's arm or leg, and regions of the support pad 201 can be tailored accordingly.

By way of example, some implementations involve cell spacing/pitch "A" of about 0.563 inches, a cell diameter "B" of about 0.5 inches (at a maximum cross-section as shown) and a cell height "C" of about 0.336 inches. A nominal inflation pressure at such sizing may be 4 psig and a nominal deflation pressure may be set equal to or less than a capillary pressure threshold for blood re-profusion, which facilitates blood flow in the patient.

In some implementations, the apparatus 200 is formed by laminating an upper membrane layer 205 with recesses for forming the pressure cells, to a lower layer 206 that seals the bottom of each pressure cell. Other embodiments involve coupling individual pressure cells to an underlying sheet. Still other embodiments involve utilizing a single material for the apparatus 200, with air injection, extrusion, molding, or other approaches.

In some embodiments, a cover or protective layer 208 is utilized to provide a positive "microclimate" (temperature and humidity) for the patient's skin. The cover 208 can be directionally compliant in the "rolling" direction of the support pad, such as along the head-to-toe direction as indicated. This may complement the shear relief aspects as noted above and achieved via the movement/roll of the respective pressure cells. The cover 208 is coupled to provide compliance in the rolling direction of the pressure cells, to mitigate the application of pressure over a deflated cell that may hinder blood flow (e.g., such that resulting contact pressure of the cover 208 against a patient's skin at locations above deflated pressure cells is below the capillary pressure threshold).

In various implementations, the support pad 201 may be implemented in accordance with the structure in apparatus 100 shown in FIG. 1. The respective pressure cells including cell 204 are implemented with the alternating structure shown in FIG. 1, in respective sets of the interleaved cells supplied by the inlet channels 130 and 132.

Figure 3:
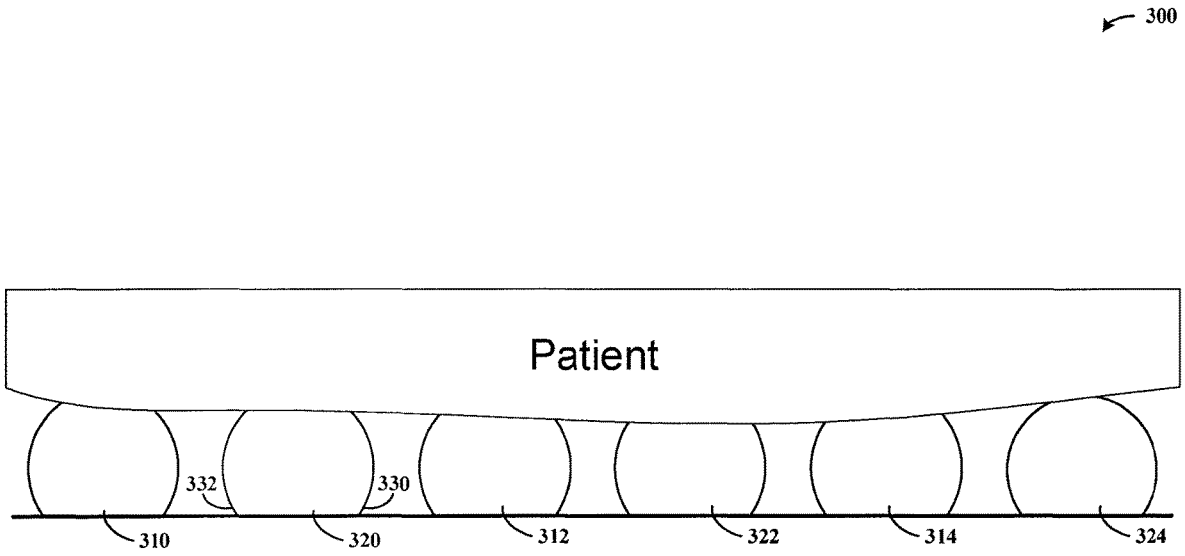
FIG. 3 shows pressure cells with an undercut, in accordance with the present disclosure.
Figure 4:
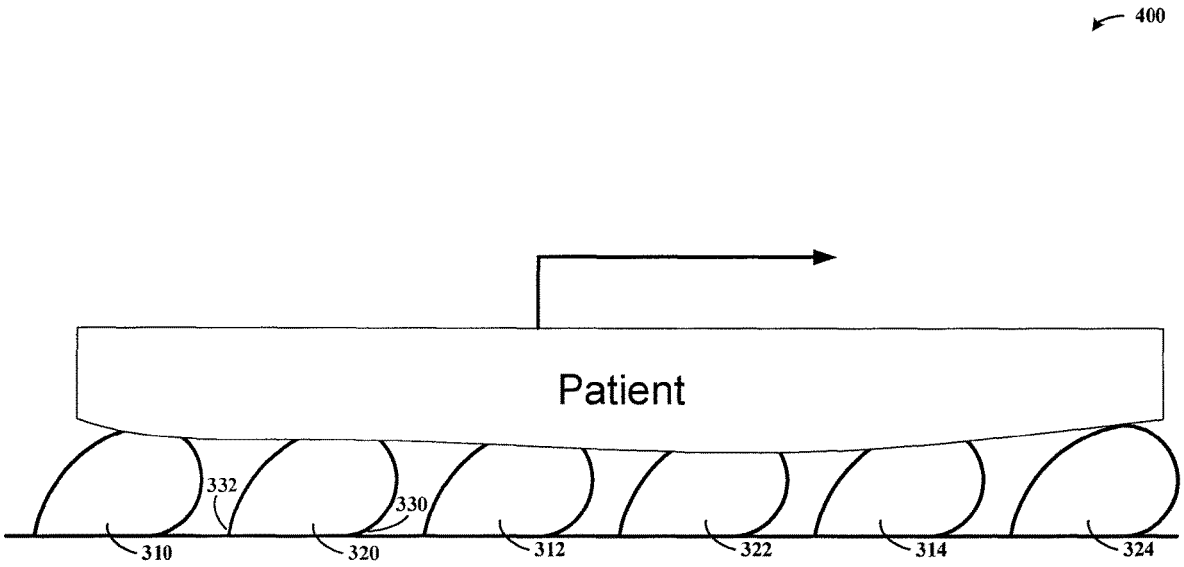
FIG. 4 shows pressure cells with an undercut and with applied shear, in accordance with the present disclosure.

FIG. 3 shows an apparatus 300 having pressure cells with an undercut, and FIG. 4 shows a similar apparatus 400 having pressure cells with an undercut and with applied shear, in accordance with the present disclosure. By way of example, similar reference numerals are used in each figure with the understanding that the indicated embodiments may be separated. Referring to FIG. 3, a first set of pressure cells includes cells 310, 312 and 314, interleaved with a second set of pressure cells 320, 322 and 324. Each cell has an undercut region at which it is attached to an underlying surface, as shown at 330 and 332. In some embodiments, the underlying surface forms part of the pressure cells and may further be used to deliver fluid. In other embodiments, fluid is delivered to (and withdrawn from) each pressure cell via an additional fluid conduit.

While the cells in FIG. 3 are shown in a neutral-type state with about no shear, the cells in FIG. 4 are shown with shear applied thereto. For instance, as the patient moves in the direction as shown by the arrow, each pressure cell rolls in the direction of the arrow, utilizing the undercut regions to provide this roll while mitigating the application of shear force on the patient. For instance, as shown at undercut region 332, the undercut allows the upper portion of pressure cell 320 to move in the direction of the arrow, taking up the undercut while the portion of the pressure cell at undercut region 330 "rolls" against the underlying surface. Movement in an opposite direction may be similarly facilitated.

The undercut shown in FIGS. 3 and 4 can be set in size, to facilitate a desired amount of shear. In some implementations, the undercut and size of pressure cells are set to facilitate movement of the patient in the direction shown of about 10 mm while providing minimal to no shear force at an interface between the patient and the pressure cells.

Figure 5:
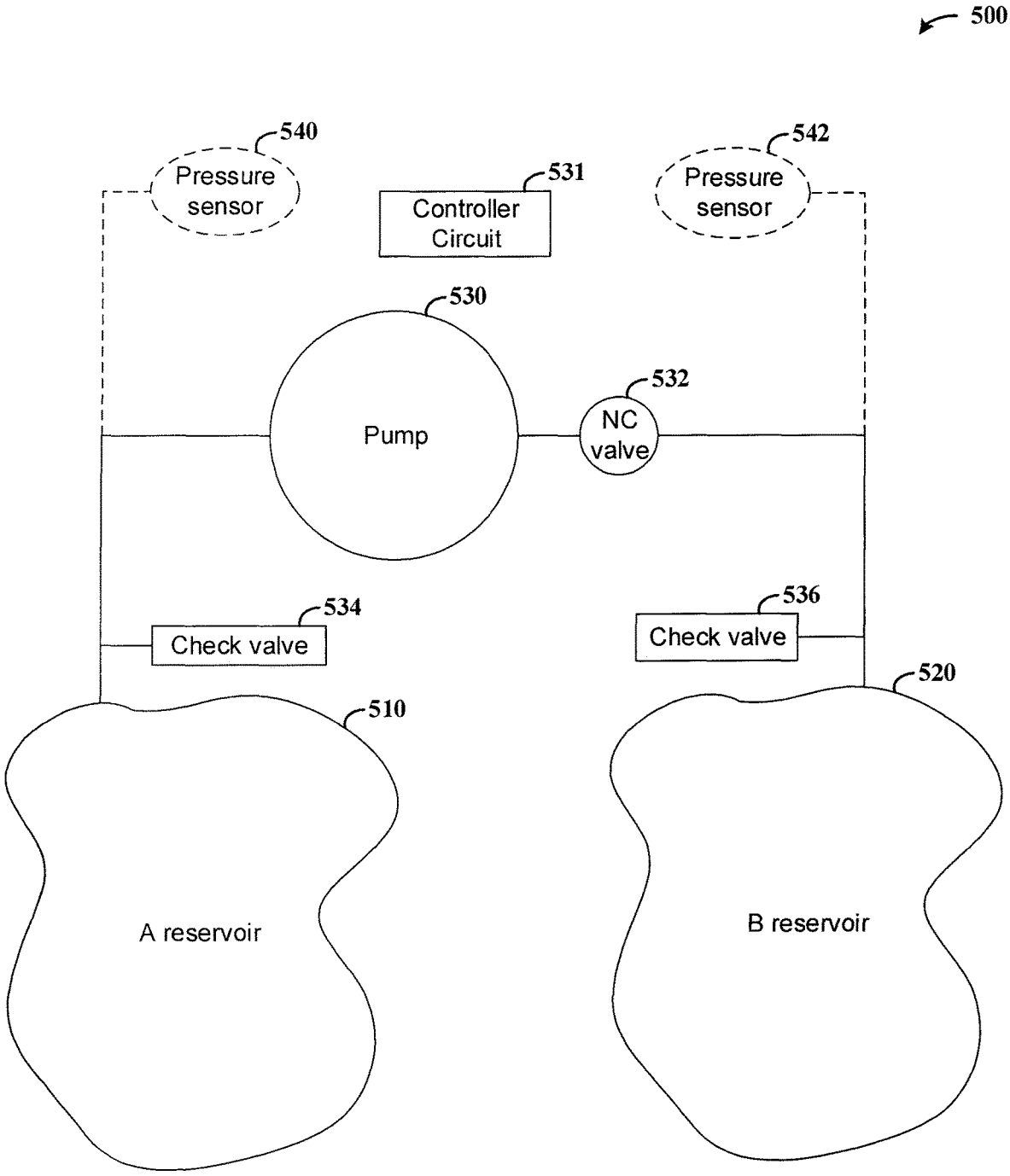
FIG. 5 shows a control apparatus in accordance with the present disclosure.

A variety of fluid delivery approaches may be implemented to suit particular embodiments. FIG. 5 shows a control apparatus 500 for such an approach, in accordance with the present disclosure. The apparatus 500 includes a pump 530 (e.g., a reversible pump) that operates to respectively inflate and deflate reservoirs 510 and 520, as implemented to provide alternating support in accordance with one or more embodiments herein. As such, the apparatus 500 may be coupled to operate the apparatus 100 shown in FIG. 1, with the respective reservoirs feeding each set of elongated pressure cells (or representing the cells themselves).

Additional componentry may be implemented with certain embodiments, including normally closed valve 532 (e.g., with a reversible pump), check valves 534 and 536, pressure sensors 540 and 542, and a controller circuit 531. Such a controller circuit 531 may, for example, include a logic circuit that operates the pump 530 and one or more valves to alternately inflate and deflate each reservoir 510 and 520.

Figure 6:
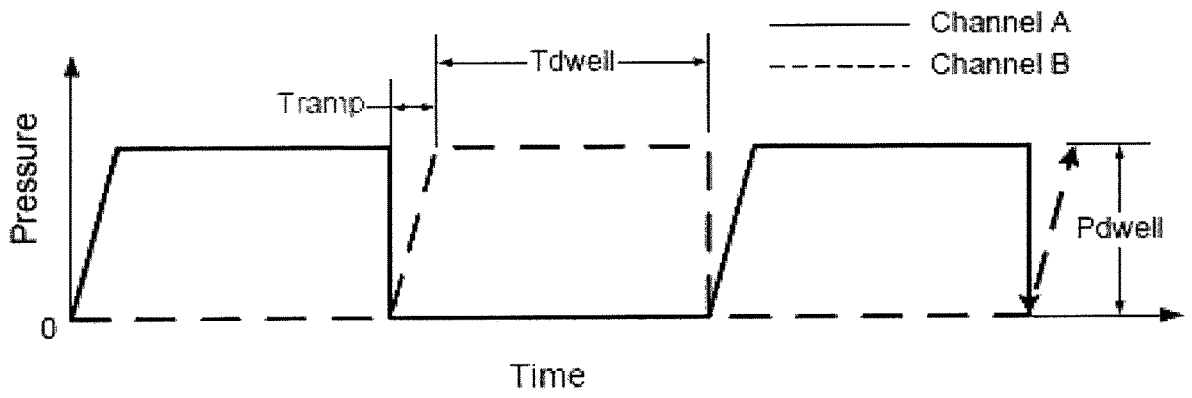
FIG. 6 shows a plot for pressure control, in accordance with the present disclosure.

FIG. 6 shows a plot for pressure control, in accordance with the present disclosure. Pressure is shown in the vertical scale, with time on the horizontal scale. Two channels are shown, channel "A" and channel "B," with each channel operable to provide inflation/deflation for a respective set of pressure cells. For instance, referring to FIG. 1 channel "A" may be used to supply fluid inlet channel 130, and channel "B" may be used to supply fluid inlet channel 132. During a first cycle, channel "A" is active to apply pressure therein. At the end of the first cycle, pressure applied in channel "A" drops and channel "B" is activated to apply pressure therein. By way of example, pressure ($P_{dwell}$) and time ($T_{dwell}$) dwells are shown, along with a ramp $T_{ramp}$ for pressurizing a set of pressure channels. Consistent with discussion herein, the respective channel activation plots may be shifted to ensure that enough pressure remains in one or a combination of adjacent pressure cells to prevent a patient from bottoming out during the transition. This approach may, for example, be implemented by the controller circuit 531 in FIG. 1.

Terms to exemplify orientation, such as upper/lower, left/right, top/bottom and above/below, may be used herein or shown in the drawings to refer to relative positions of components, such as those shown in the figures. It should be understood that the terminology is used for notational convenience only and that in actual use the disclosed structures may be oriented different from the orientation shown in the figures. Thus, the terms should not be construed in a limiting manner.

The skilled artisan would recognize that various terminology as used in the Specification (including claims) connote a plain meaning in the art unless otherwise indicated. As examples, the specification describes and/or illustrates aspects useful for implementing the claimed disclosure by way of various circuits or circuitry which may be illustrated as or using terms such as blocks, modules, device, system, unit, controller, clamp and/or other circuit-type depictions (e.g., controller circuit 531 of FIG. 5 may depict a block/module in this context). Such circuits or circuitry are used together with other elements to exemplify how certain embodiments may be carried out in the form or structures, steps, functions, operations, activities, etc. As another example, where the Specification may make reference to a "first [type of structure]", a "second [type of structure]", etc., where the [type of structure] might be replaced with terms such as ["circuit", "circuitry" and others], the adjectives "first" and "second" are not used to connote any description of the structure or to provide any substantive meaning; rather, such adjectives are merely used for English-language antecedence to differentiate one such similarly-named structure from another similarly-named structure (e.g., "first circuit configured to clamp . . . " is interpreted as "circuit configured to clamp . . . ").

Based upon the above discussion and illustrations, those skilled in the art will readily recognize that various modifications and changes may be made to the various embodiments without strictly following the exemplary embodiments and applications illustrated and described herein. For example, methods that may be implemented in forming the apparatuses characterized herein or as otherwise noted in the Figures may involve steps carried out in various orders, with one or more aspects of the embodiments herein retained, or may involve fewer or more steps. The respective elongated portions may be implemented with different arrangements to achieve a particular effect. As another example, different types of materials and configurations can be used to facilitate anti-shear effects. Such modifications do not depart from the true spirit and scope of various aspects of the disclosure, including aspects set forth in the claims.

What is claimed is:

1. An apparatus comprising:

a first set of elongated pressure cells;

a second set of elongated pressure cells interleaved with the elongated pressure cells of the first set, each of the first and second sets of the elongated pressure cells having a length and width; and fluid delivery componentry being configured and arranged to inflate one of the first and second sets while deflating the other of the first and second sets by evacuating fluid from the other of the first and second sets and utilizing the evacuated fluid to fully inflate the one of the first and second sets while the other of the first and second sets is fully evacuated, the first and second sets of elongated pressure cells being configured to, while one of the sets is inflated and the other one of the sets is deflated, provide shear relief by deflecting in a direction that is perpendicular to the length of the elongated pressure cells.

2. The apparatus of claim 1, wherein each elongated pressure cell includes respective undercut regions extending along a length of the elongated pressure cell at intersections between the pressure cell and an underlying surface, the width of the elongated pressure cell at the intersection being less than a width of a cross-section of the pressure cell that is elevated above the intersection.

3. The apparatus of claim 2, wherein the width of the elevated cross-section is sufficiently larger than the width of the elongated pressure cell at the intersection to facilitate deflection of an upper portion of the elongated pressure cell in a direction along the width thereof, thereby providing the shear relief.

4. The apparatus of claim 3, wherein each of the elongated pressure cells in one of the sets is configured and arranged with an upper surface that, when in contact with and supporting a patient, is configured and arranged to deflect 10 mm along a direction of the width relative to the intersections with the underlying surface, while the pressure cells in the other one of the sets are deflated.

5. The apparatus of claim 4, wherein each elongated pressure cell is configured and arranged to exhibit the deflection when inflated and in contact with a patient supported by the elongated pressure cell.

6. The apparatus of claim 2, wherein the width of the elongated pressure cell at the intersection is less than a width of a cross-section of the elongated pressure cell that is elevated above the intersection when the pressure cell is filled with fluid that supports weight of a patient.

7. The apparatus of claim 1, wherein the elongated pressure cells in the first set of elongated pressure cells are fluidly coupled to inflate and deflate together, and the elongated pressure cells in the second set of elongated pressure cells are fluidly coupled to inflate and deflate together.

8. The apparatus of claim 7, wherein the fluid delivery componentry includes valving and a pump configured and arranged to inflate and deflate the first set of elongated pressure cells and the second set of elongated pressure cells independently from one another for respective periods of time.

9. The apparatus of claim 8, wherein the valving and pump are configured and arranged to alternately inflate and deflate adjacent ones of the elongated pressure cells by:

inflating the first set of elongated pressure cells during a first period of time while the second set of elongated pressure cells is deflated; and inflating the second set of elongated pressure cells during a second period of time while the first set of elongated pressure cells is deflated.

10. The apparatus of claim 8, wherein the valves are configured and arranged with the pump and the sets of elongated pressure cells to evacuate fluid from one of the sets of elongated pressure cells and to utilize the evacuated fluid to inflate the other one of the sets of elongated pressure cells.

11. The apparatus of claim 8, wherein the pump is a reversible pump and the valves are configured and arranged with the reversible pump and the sets of elongated pressure cells to evacuate fluid from one of the sets of elongated pressure cells and to utilize the evacuated fluid to inflate the other one of the sets of elongated pressure cells.

12. The apparatus of claim 1, wherein sets of elongated pressure cells are in an upper sheet that is laminated to a lower sheet, the upper and lower sheet forming the respective cells when laminated.

13. The apparatus of claim 1, further including third and fourth sets of elongated pressure cells, each elongated pressure cell in the third set being interleaved with elongated pressure cells of the fourth set and having a length extending in a direction that is different than the direction of the length of the elongated pressure cells in the first and second sets of elongated pressure cells.

14. The apparatus of claim 1, wherein adjacent ones of the elongated pressure cells are spaced relative to one another such that sidewalls of the adjacent ones of the elongated pressure cells do not contact one another when inflated and supporting a patient's weight; and the elongated pressure cells are configured and arranged to, with one of the sets of elongated cells filled with fluid and on an underlying surface, prevent flattening of the pressure cells onto the underlying surface under a patient's weight with the other one of the sets of elongated cells being evacuated.

15. The apparatus of claim 14, wherein the sets of elongated pressure cells are configured and arranged at a spacing that provides support sufficient to prevent contact between the patient and the underlying surface when one of the sets of elongated pressure cells is filled with the fluid and the other one of the sets of elongated pressure cells is about empty.

16. The apparatus of claim 1, wherein sets of elongated pressure cells have a lower portion coupled to an underlying sheet and an upper portion that is uncoupled and configured to relieve shear applied to the cells by deflecting laterally relative to the underlying sheet.

17. A method comprising:

forming a membrane having recesses therein, including recesses for:

a first set of elongated pressure cells;

a second set of elongated pressure cells interleaved with the elongated pressure cells of the first set, each of the first and second sets of the elongated pressure cells having a length and width;

a first pressure inlet channel coupled to the first set of elongated pressure cells; and a second pressure inlet channel coupled to the second set of elongated pressure cells; and sealing the elongated pressure cells by coupling the membrane to an underlying sheet, and connecting the elongated pressure cells to fluid delivery componentry, therein configuring each set of the elongated pressure cells with the fluid delivery componentry to:

inflate and deflate independently of the other of the first and second sets, including fully inflating one of the first and second sets while fully evacuating the other of the first and second sets by evacuating fluid from the other of the first and second sets and utilizing the evacuated fluid to fully inflate the one of the first and second sets, and while one of the sets is inflated and the other one of the sets is deflated, provide shear relief by deflecting in a direction that is perpendicular to the length of the elongated pressure cells.

18. The method of claim 17, wherein sealing the elongated pressure cells by coupling the membrane to an underlying sheet includes laminating the membrane to the underlying sheet.

19. The method of claim 17, wherein forming the membrane includes:

selecting a size of the recesses that is, when coupled to the underlying sheet, sufficient to support a patient having a target weight and to prevent flattening of the pressure cells onto an underlying surface while supporting the patient, and forming the recesses to the selected size.

20. The method of claim 17, wherein forming the respective sets of elongated pressure cells includes forming each elongated pressure cell with respective undercut regions extending along a length of the pressure cell at intersections between the pressure cell and an underlying surface, the width of the elongated pressure cell at the intersection being less than a width of a cross-section of the elongated pressure cell that is elevated above the intersection.

21. The method of claim 20, wherein forming the respective sets of elongated pressure cells includes forming each elongated pressure cell with the elevated cross-section having a width that is sufficiently larger than the width of the elongated pressure cell at the intersection to facilitate deflection of an upper portion of the elongated pressure cell in a direction along the width thereof, thereby providing the shear relief.

* * * * *